United States Patent [19]

Fischer et al.

[11] Patent Number: 4,958,864

[45] Date of Patent: Sep. 25, 1990

[54] LOCK TO PREVENT CASUAL THEFT

[75] Inventors: Roy Fischer, Scottsdale; Paul F. Fair, Phoenix, both of Ariz.

[73] Assignee: Kimberly-Clark Corporation, Neenah, Wis.

[21] Appl. No.: 405,483

[22] Filed: Sep. 11, 1989

Related U.S. Application Data

[63] Continuation-in-part of Ser. No. 334,512, Apr. 6, 1989, abandoned.

[51] Int. Cl.[5] ..... E05C 7/00

[52] U.S. Cl. ..... 292/19; 292/27; 292/49

[58] Field of Search ..... 292/19, 49, 27, 20, 292/29, 52

[56] References Cited

U.S. PATENT DOCUMENTS

| | | | |
|---|---|---|---|
| 345,337 | 7/1886 | Tollher . | |
| 354,597 | 12/1886 | Crouch . | |
| 857,322 | 6/1907 | Baker . | |
| 1,147,530 | 7/1915 | Mentz . | |
| 1,439,229 | 12/1922 | Cohon et al. . | |
| 1,599,150 | 9/1926 | Taillefer . | |
| 2,507,511 | 5/1950 | Freidag et al. | 292/19 |
| 2,976,714 | 3/1961 | Hofgesang | 70/63 |
| 4,500,120 | 2/1985 | Ridgewall et al. | 292/19 |
| 4,662,664 | 5/1987 | Wendt et al. | 292/19 |

FOREIGN PATENT DOCUMENTS

| | | | |
|---|---|---|---|
| 692727 | of 1927 | Australia . | |
| 69991 | 7/1892 | Fed. Rep. of Germany . | |
| 142317 | 11/1902 | Fed. Rep. of Germany . | |
| 1678017 | 12/1969 | Fed. Rep. of Germany . | |
| 385542 | 12/1907 | France . | |
| 2983 | of 1902 | United Kingdom . | |
| 22523 | of 1903 | United Kingdom . | |
| 87910 | 1/1921 | United Kingdom | 292/27 |
| 372878 | 5/1932 | United Kingdom . | |
| 800955 | 9/1958 | United Kingdom . | |
| 852327 | 10/1960 | United Kingdom . | |

*Primary Examiner*—Robert L. Wolfe

*Attorney, Agent, or Firm*—William D. Herrick

[57] ABSTRACT

There is disclosed a lock to prevent casual theft from dispensers. The lock includes a catch on one wall and a rotatable cam and a release spring with a latch on a second wall. The second wall has a bore for a key slot, an integral mounting post for the release spring, and integral mounting brackets for a retainer plate to hold the release spring and rotatable cam in position. The lock has a rotatable bore cover to inhibit operation of or damage to the lock. The cam is restricted in rotation and has cam profiles which cause the release spring to return to its closed position when the key is released.

6 Claims, 3 Drawing Sheets

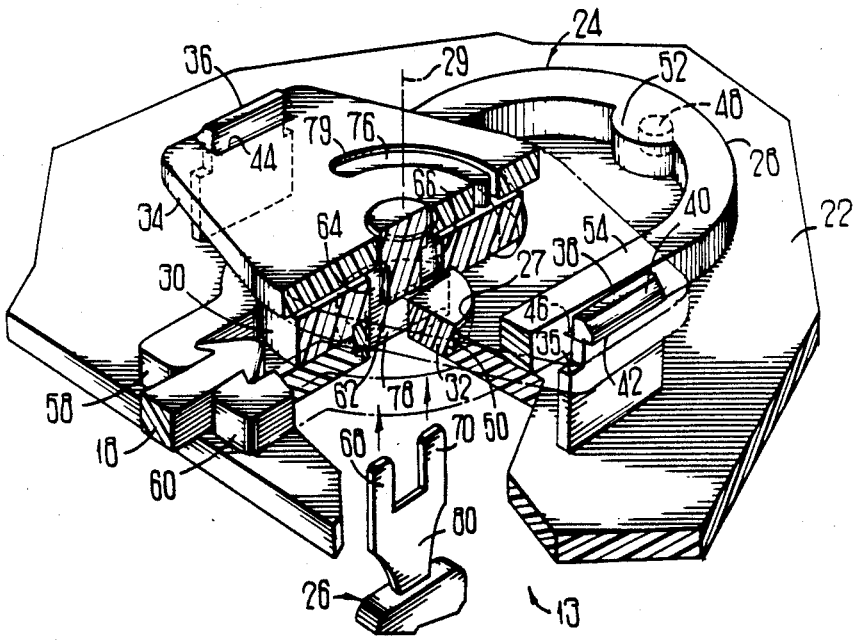
FIG 2
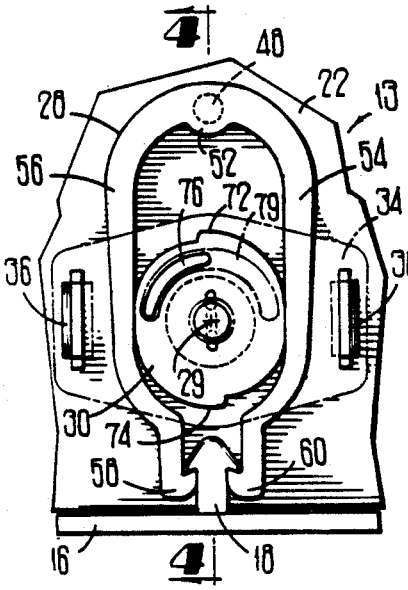
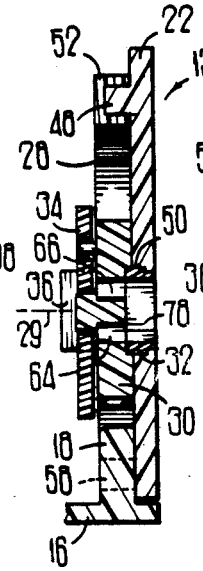
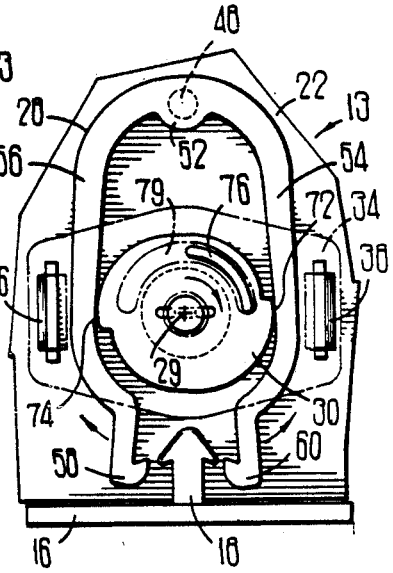
FIG 3 FIG 4 FIG 5

LOCK TO PREVENT CASUAL THEFT

RELATED CASE

This application is a continuation-in-part of our application Ser. No. 07/334512, filed Apr. 6, 1989, abandoned.

BACKGROUND OF THE INVENTION

This invention relates generally to locks, and more particularly concerns a lock to prevent casual theft or pilferage from containers which hold items of small value.

Containers such as paper product dispensers, suitcases, carrying cases, drawers, and cabinets may be situated in public places where such containers if not locked, would be subjected to consistent and annoying casual theft and pilferage even though the contents of such containers generally are not of great value. Consequently, it is desirable to have some sort of lock for such containers in order to discourage casual theft or pilferage. In general, such containers themselves are made of plastic and will not hold up to serious assault in any event. Therefore, there is no need to design a lock which will be more indestructible than the containers themselves.

A lock for such containers, which are made of plastic and contain items of small value, should be easy to operate so that authorized personnel with an appropriate key can easily open and service such containers as in the case of toilet paper dispensers. The lock, however, should not be easily opened or damaged by means of ordinary tools such as a screwdriver, knife or the like which may be readily available to unauthorized personnel.

In that regard, a lock for a toilet paper dispenser is the subject of Ridgewell et al. U.S. Pat. No. 4,500,120 assigned to a subsidiary of the assignee of the present invention. The lock disclosed in the Ridgewell et al. patent is designed to prevent casual theft from containers which hold items of small value. The Ridgewell et al. lock includes a hasp on one wall of the container which engages a latch at one end of a release spring. The other end of the release spring is attached to a second wall on the other half of the container by means of a screw. A rotatable cam having a generally triangular shaped cam surface is mounted for rotation between the two sides of the release spring so that the latch can be spread to disengage the hasp when the key turns the cam. The cam profile and the release spring are designed so that a cam can be rotated to a point at which the cam is wedged between the two halves of the release spring so that the release spring remains open. In other words, the release spring will not cause the cam to rotate back to its initial position thereby closing the lock once rotational force is removed from the key. Therefore, unless the operator specifically acts to rotate the cam back to its original position, the dispenser when closed will not be locked. The key hole and the mounting screw for the release spring are offset so that any downward axial force exerted by the operator on the key tends to push the release spring away from the wall to which it is mounted by the screw. Because of the offset, a lever action is created which can cause the release spring to break away from the mounting screw, thereby rendering the lock inoperable. Moreover, the rotatable cam has a single slot key hole which invites a person to try to force the lock with any number of readily available objects, such as screwdriver, pocket knife, or the like. When the lock is forced with a screwdriver, there is a great chance of damage to the dispenser and the lock.

SUMMARY OF THE INVENTION

It is therefore an object of the present invention to provide a lock for a container which holds items of small value.

More particularly, it is an object of the present invention to provide a lock which will resist breakage due to an axial force exerted by the key into the key hole of the lock.

It is also an object of the present invention to provide a lock mechanism which cannot be engaged or operated by ordinarily available tools such as screwdrivers, pocket knives or the like.

It is further an object of the present invention to provide a lock which when the key is removed from the key hole will automatically spring back to its locked configuration.

It is further an object of the present invention to provide a lock for a container that can be assembled quickly without any tools The foregoing objectives are accomplished by a lock for a container which connects a first container wall to a second container wall by means of a catch on the first wall and a release spring with a latch on the second wall. The second wall has a bore with an axis, integral mounting brackets positioned about the bore, and a mounting post for the release spring. The release spring has a coupling means at one end to engage the post and the latch at the other end to engage the catch. A rotatable cam is mounted to rotate about the axis of the bore and has a keyway consisting of separate chambers to accept a key having a two pronged profile. The lock has a freely rotatable bore cover with a continuous key slot which provides access to the keyway in the rotatable cam. The rotatable cam has a cam surface that engages the release spring to spread the spring arms and thereby disengage the latch from the catch. The cam is restricted in its rotation, and the cam surface is profiled so that once the rotational force is removed from the key, the release spring causes the cam to rotate back to its original locked position. A retainer plate covers the cam and the release spring and is held in place by the integral mounting brackets so that any axial force produced by the key will be born directly by the retainer plate thereby eliminating any downward force being transmitted to the release spring.

BRIEF DESCRIPTION OF THE DRAWINGS

FIG. 2 is a perspective view of the lock mechanism of the present invention with portions cut away to show internal detail;

FIG. 3 is a top plan view of the lock mechanism of the present invention showing the lock in the closed position;

FIG. 4 is a section view of the lock mechanism of the present invention as seen along line 4-4 of FIG. 3;

FIG. 5 is a top plan view of the lock mechanism of the present invention showing the lock in its open position;

DETAILED DESCRIPTION OF THE INVENTION

While the invention will be described in connection with a preferred embodiment, it will be understood that we do not intend to limit the invention to that embodiment. On the contrary, we intend to cover all alternatives, modifications, and equivalents as may be included within the spirit and scope of the invention as defined by the appended claims.

Figure 1:
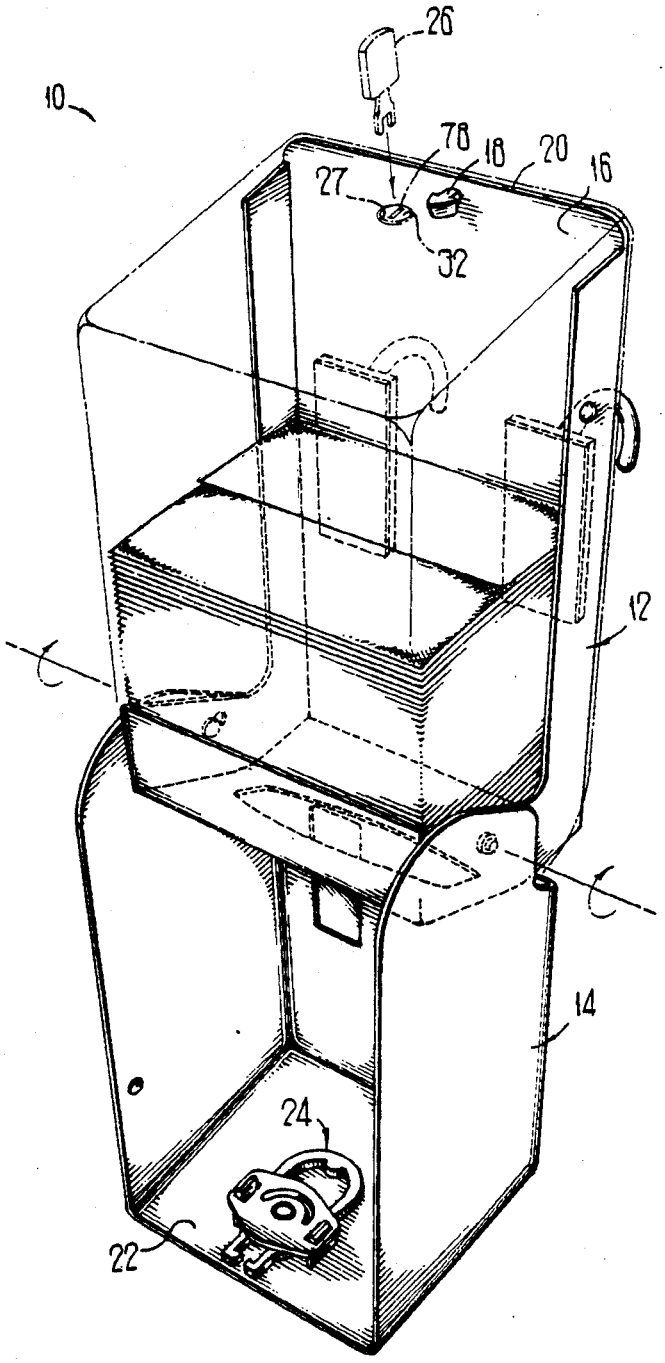
FIG. 1 is a perspective view of a toilet tissue dispenser on which the lock of the present invention is used.

Turning to FIG. 1 there is shown illustratively a molded plastic, toilet tissue dispenser 10 consisting of a first half section 12 and a hingedly mounted second half section 14. The half section 12 has a wall 16 which forms the back of the dispenser 10, and the half section 14 has a wall 22 which forms the top of the dispenser 10. A lock 13 (FIG. 2) consists of a plastic catch 18 attached to the wall 16 near the top edge 20 and a plastic lock mechanism 24 attached to the wall 22. The plastic lock mechanism 24 made in accordance with the present invention is attached to the wall 22 on the inside of the dispenser 10. The lock mechanism 24 is operated by a key 26.

Turning to FIG. 2 the lock mechanism 24 is shown in greater detail. The lock mechanism 24 comprises the wall 22, a release spring 28, bore 27 a rotatable cam 30, a bore cover 32, and a retainer plate 34.

With continuing reference to FIG. 2, the wall 22 has a bore 27 with an axis 29, two integrally formed mounting brackets 36 and 38 extending away from the wall 22, and an integral round post 48. Each mounting bracket is flexible and has a beveled surface 40 and a retaining surface 42. The plastic mounting brackets serve to hold down the retainer plate 34. The retainer plate 34 has holes 44 and 46 which accommodate the mounting brackets 36 and 38. The retainer plate 34 is pushed down against the beveled surface 40 of each mounting bracket forcing the mounting bracket inwardly until the retainer plate 34 is seated on stops 35 and is under the retaining surface 42. The retainer plate 34 is removed by manually pulling the mounting brackets 36 and 38 inwardly to allow the retainer plate 34 to clear the holding surface 42. It should be noted that the mounting brackets 36 and 34 are in alignment with the axis 29 of the bore 27 and that the post 48 is aligned at 90° to a line passing through the mounting brackets 36 and 38 and the bore axis 29.

The release spring 28 is made of molded plastic and has the general shape of a hair pin as shown in FIG. 3. The release spring 28 has coupling means 52 at one end which is a hole that fits over the post 48 molded in the wall 22. The release spring includes side arms 54 and 56 which extend from the coupling means to the other end and terminate in latches 58 and 60. As can be seen in FIG. 2 and 3, the latches 58 and 60 engage the catch 18 by means of the camming surfaces on the catch and the latching fingers which allow the release spring arms 54 and 56 to be spread and then snapped back into place.

The rotatable cam 30 is rotatably mounted in alignment with the axis 29 of the bore 27. The cam 30 has a keyway 62 which consists of separate chambers 64 and 66. The separate chambers 64 and 66 are provided to accommodate prongs 68 and 70 of key 26. Consequently, when the key 26 is inserted into the rotatable cam 30, the prongs engage the chambers in order to rotate the cam 30.

As can be clearly seen in FIG. 4, the cam cover 32 is supported by a lip 50 and is freely rotatable in the bore 27. The cam cover 32 has a continuous key slot 78. The key slot 78 accommodates the unitary portion 80 of the key 26. In order to insert the key 26, it is necessary to rotate the key slot 78 into alignment with the separate chambers 64 and 66 of the rotatable cam 30. If on the other hand, an instrument such as a screwdriver with a unitary blade is inserted into the key slot 78, the blade of the screwdriver will not engage the separate chambers 64 and 66 and cannot serve to turn the cam 30. Instead, only the cam cover 32 will turn freely without opening the lock 24 and without damage to the lock or dispenser.

The cam 30 also has camming surfaces 72 and 74 which engage the inside of flexible arms 54 and 56. As the cam is rotated clockwise (as seen in FIG. 3) the camming surfaces 72 and 74 serve to force the spring arms 54 and 56 outward to unlatch the latches 58 and 60 as shown in FIG. 5. As also can be seen in FIGS. 3 and 5, the cam has an arcuate shaped stop 76 which engages complimentary arcuate shaped groove 79 in order to restrict the rotation of the cam 30 to less than 90°. Consequently, the cam 30 cannot be rotated to a position where the arms 54 and 56 will be wedged open. Therefore, the spring tension exerted by the spring arms 54 and 56 against the cam surfaces 72 and 74 will always cause the cam to return to its initial locked postion shown in FIG. 3 once the rotational force exerted by the key has been removed.

It should also be appreciated that when the key 26 is inserted, and pushed into the separate chamber 64 and 66, it will exert a force directly on the retainer plate 34 which is held in place by the integral snap brackets 34. Unlike the prior art device, there is no force exerted directly onto the release spring or its arms as a result of an axial force exerted on the key. Consequently, the chance of the release spring breaking is eliminated.

Figure 6:
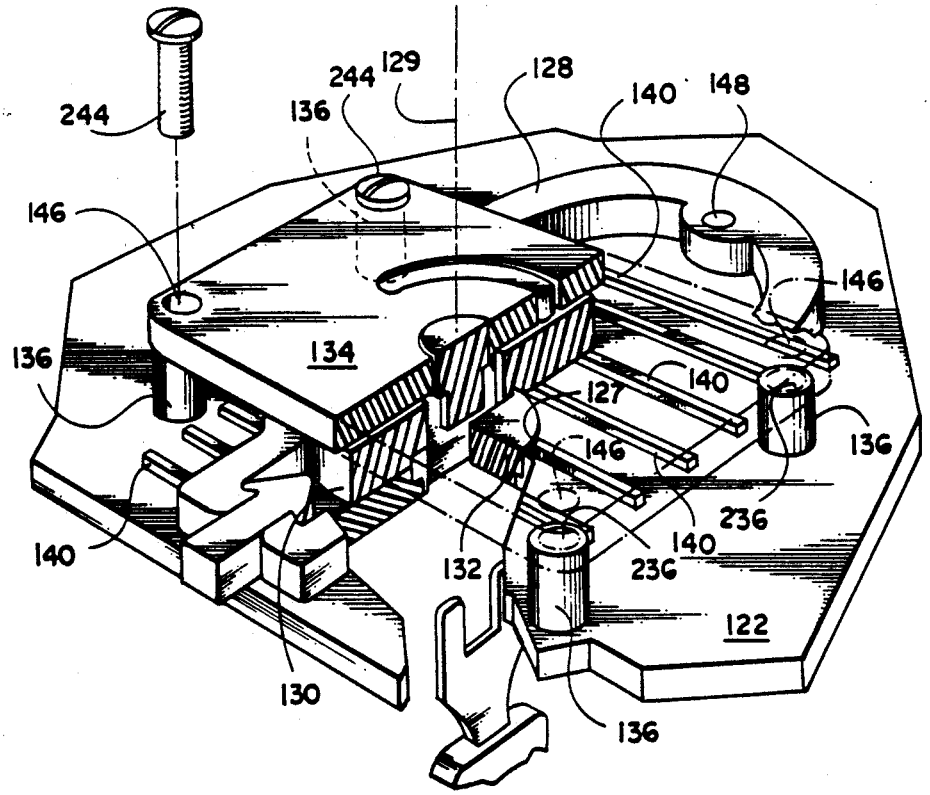
FIG. 6 is a perspective view of an alternative embodiment of the lock mechanism of the present invention with portions cut away to show internal detail.

Turning to FIG 6, there is shown an alternative lock mechanism 124 to be incorporated into the lock 13 instead of lock mechanism 24. The alternative lock mechanism 124 is similar to lock mechanism 24 except for the mounting of retainer plate 134. The alternative lock mechanism 124 comprises a wall 122, a release spring 128, a rotatable cam 130, a bore cover 132, and retainer plate 134. The wall 122 has a bore 127 with an axis 129 and four integrally formed mounting brackets or bosses 136 upstanding from the wall 122 and positioned about the bore 127. An integral post 148 is also provided for connection to release spring 128. Each mounting bracket has a hole 236 which holes will accept self-tapping screws 244. In addition, ribs 140 are provided adjacent the bore 127 of the wall 122. The ribs 140 add structural rigidity to the wall 122. The retainer plate 134 has holes 146 through which self-tapping screws 244 pass for connecting the retainer plate 134 to the mounting brackets 136. The self-tapping screws threaded into bosses 136 serve to hold the retainer plate 134 down against cam 130, and any axial force exerted on the cam by insertion of a key or other object is born by the retainer plate 134 instead of by the spring 128.

We claim:

1. A lock comprising:

a. a first wall having a catch attached thereto;

b. a second wall having:

i. a bore with a bore axis;

ii. mounting brackets positioned about the bore; and iii. a post positioned adjacent the bore;

c. a release spring having coupling means at one end for engaging the post and having a latch at its other end for engaging the catch;

d. a cam rotatable about the bore axis and having:

i. a keyway for accepting a key; and ii. a cam surface for engaging the release spring and thereby disengaging the latch;

e. a retainer plate extending between and engaging the mounting brackets to hold the rotatable cam in place against an axial force exerted on the cam by insertion of the key into the keyway of the cam.

2. The lock of claim 1, wherein the lock further comprises a bore cover rotatably mounted in the bore and having a continuous key slot which provides access to the keyway in the rotatable cam and wherein the key has separate extending prongs and the keyway comprises separate chambers for accepting the prongs when the key slot in the bore cover is rotated into alignment with the chambers of the keyway.

3. The lock of claim 1, wherein the rotatable cam and retainer plate have complimentary stop and groove means for restricting the degree of rotation of the rotatable cam and the cam surface is profiled so that the release spring produces a rotational force on the rotatable cam within the degrees of restricted rotation of the rotatable cam.

4. The lock of claim 2, wherein the rotatable cam and retainer plate have complementary stop and groove means for restricting the degree of rotation of the rotatable cam and the cam surface is profiled so that the release spring produces a rotational force on the rotatable cam within the degrees of restricted rotation of the rotatable cam.

5. The lock of claim 1, wherein the mounting brackets are positioned on either side of the bore and are flexible and each includes a beveled surface and a retaining surface and wherein the retainer plate has an indentation at each end that mates with the mounting brackets to first spread the brackets by engaging the beveled surface and then to be retained by engaging the retaining surface.

6. The lock of claim 1, wherein the mounting brackets comprise a plurality of upstanding bosses for accepting fasteners and wherein the retainer plate has matching holes that align with the bosses so that the fasteners can connect the retainer plate to the bosses.

* * * * *

UNITED STATES PATENT AND TRADEMARK OFFICE

CERTIFICATE OF CORRECTION

PATENT NO. : 4,958,864

DATED : September 25, 1990

INVENTOR(S) : Roy Fishcher, et al

It is certified that error appears in the above-identified patent and that said Letters Patent is hereby corrected as shown below:

Column 4, line 24, "complimentary" should read --complementary--

Column 5, line 24, "complimentary" should read --complementary--

Signed and Sealed this

Seventh Day of July, 1992

*Attest:*

DOUGLAS B. COMER

*Attesting Officer*

*Acting Commissioner of Patents and Trademarks*